US007285020B2

(12) United States Patent
Riku

(10) Patent No.: US 7,285,020 B2
(45) Date of Patent: Oct. 23, 2007

(54) ELECTRICAL CONNECTOR

(75) Inventor: Kazuya Riku, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/550,026

(22) Filed: Oct. 17, 2006

(65) Prior Publication Data

US 2007/0087589 A1 Apr. 19, 2007

(30) Foreign Application Priority Data

Oct. 17, 2005 (JP) ..... 2005-301145

(51) Int. Cl.
*H01R 13/66* (2006.01)

(52) U.S. Cl. ..... 439/620.21

(58) Field of Classification Search ..... 439/620.01–620.34

See application file for complete search history.

(56) References Cited

U.S. PATENT DOCUMENTS 5,213,522 A * 5/1993 Kojima ..... 439/620.07

FOREIGN PATENT DOCUMENTS

JP 2005-301145 10/2005

* cited by examiner

*Primary Examiner*—Ross Gushi
(74) *Attorney, Agent, or Firm*—Barley Snyder LLC

(57) ABSTRACT

An electrical connector comprises an axial lead component and signal contacts. Each of the signal contacts has a contact area and a base formed opposite from the contact area, which is electrically connected to a lead end of the axial lead component. An insulative inner housing has a main body portion that receives the signal contacts. The main body portion has a substantially concave component housing region proximate the base of the signal contact that receives a main body of the axial lead component. An insulative spacer formed separate from the inner housing is attached to the main body portion proximate the component housing region. The spacer has a groove with a metal terminal plate disposed therein that is electrically connected to another lead end of the axial lead component. The spacer attached to the inner housing is selected according to the dimensions of the axial lead component.

19 Claims, 14 Drawing Sheets

ELECTRICAL CONNECTOR

FIELD OF THE INVENTION

The present invention relates to an electrical connector that is capable of internally accommodating an axial lead component.

BACKGROUND OF THE INVENTION

Various standards have been established for electrical connectors used to interconnect information equipment. The Universal Serial Bus (USB) and Institute of Electrical and Electronics Engineers (IEEE) 1394 standards are known as representative examples of such.

In order to add required functionality, these types of electrical connectors are configured to internally house an electronic component. For example, FIGS. 14(A)-(B) shows a type-A plug or electrical connector 500 that conforms to the USB standard (FIG. 8 of Unexamined Patent Application Publication JP2002-190412). The plug 500 internally houses an inductor (common mode choke coil) L20 in order to add a noise suppression effect to the plug 500.

As shown in FIG. 14(A), in the electrical connector 500, an inductor L10 is connected between a pair of signal contacts 521 and a pair of signal lines w1 of a cable W. As shown in FIG. 14(B), the inductor L10 is mounted on a small circuit board 550 and is inserted between the pair of signal contacts 521 and the pair of signal lines w1 via a pair of signal pins 551*a*, 551*b* provided at an end of the circuit board 550. Similarly, the inductor L20 is inserted via a pair of power supply pins 552*a*, 552*b* provided at either end of the circuit board 550 between a pair of power supply contacts 522 and a pair of power supply lines w2 of the cable W.

The inductor L10 connected between the signal contacts 521 and the signal lines w1 of the cable W and the inductor L20 connected between the power supply contacts 522 and the power supply lines w2 of the cable W are both mounted on the circuit board 550 and housed within a metal shell 530 of the electrical connector 500. Functioning as a shield, the metal shell 530 is connected to a shield layer S that covers the signal lines w1 and power supply lines w2 of the cable W. Except for a mating portion 510 at a front end of the metal shell 530, the metal shell 530 that houses the circuit board 550 is molded with an insulative resin 560.

An electrical connector that conforms to the USB standard or other standards must maintain compatibility, and therefore has a restriction in that the shape of the mating portion cannot be changed arbitrarily. Moreover, because the overall configuration, including the insulative housing, of such an electrical connector has a small size and low profile, there is the problem in that the usable space for accommodating an electronic component within the insulative housing is extremely small.

For example, in the electrical connector 500 previously described, the dimensions of the usable space for accommodating the circuit board 550 within the metal shell 530 do not exceed 10 mm in the vertical and horizontal directions, and the height is approximately 3 mm. In consideration of the fact that the circuit board 550 has a thickness of approximately 0.5 to 1 mm, electronic components capable of being mounted on the circuit board 500 and being positioned inside the metal shell 530 of the electrical connector 500 are limited to electronic components having a height of not more than 2 mm. Thus, the electronic components capable of being housed inside this small-size low-profile electrical connector were limited to surface mountable components such as chip-type components.

Depending on the usage conditions of an electrical connector that houses an electronic component, due to an inability to satisfy required specifications for chip-type electronic components or for other reasons, the electrical connector may, in some cases, be required to internally house a lead-type electronic component. However, with a small-size low-profile electrical connector such as the USB connector previously described, space is limited inside the insulative housing, and it is therefore difficult to position lead-type electronic components therein. Moreover, since lead-type electronic components come in a wider variety of sizes and shapes than chip-type components, there is also a problem in that the shape of the insulative housing must be changed for each lead-type electronic component.

BRIEF SUMMARY OF THE INVENTION

It is an objective of the present invention to provide an electrical connector that conforms to a prescribed standard such as the USB standard that is capable of accommodating axial lead components without significantly changing the shape of the electrical connector. Another objective of the present invention is to provide an electrical connector that does not require advance preparation of a plurality of types of insulative housings corresponding to each internally housed axial lead component in the case where the internally housed axial lead components differ in shape and size.

This and other objects are achieved by an electrical connector for accommodating an axial lead component, wherein the electrical connector comprises at least one signal contact having a contact area. The signal contact has a base formed opposite from the contact area that is configured to be electrically connected to a lead end of the axial lead component. An insulative inner housing has a main body portion that receives the signal contact. The main body portion has a substantially concave component housing region proximate the base of the signal contact that is configured for receipt of a main body of the axial lead component. A spacer is formed separate from the inner housing that is attached to the main body portion proximate the component housing region. The spacer has a groove configured for receipt of another lead end of the axial lead component.

This and other objects are further achieved by an electrical connector comprising an axial lead component and signal contacts. Each of the signal contacts has a contact area and a base formed opposite from the contact area, which is electrically connected to a lead end of the axial lead component. An insulative inner housing has a main body portion that receives the signal contacts. The main body portion has a substantially concave component housing region proximate the base of the signal contact that receives a main body of the axial lead component. An insulative spacer formed separate from the inner housing is attached to the main body portion proximate the component housing region. The spacer has a groove with a metal terminal plate disposed therein that is electrically connected to another lead end of the axial lead component. The spacer attached to the inner housing is selected according to the dimensions of the axial lead component.

DETAILED DESCRIPTION OF THE INVENTION

A preferred embodiment of an electrical connector 100 of the present invention is described below with reference to FIGS. 1(A) to 13(B). The electrical connector 100 illustrated herein is configured as a USB-standard A-type plug. Orientations within the drawings are indicated in terms of up-down and left-right directions. Moreover, elements that are common among the drawings are assigned the same identifying symbols and further descriptions thereof are omitted where appropriate.

Figure 1A:
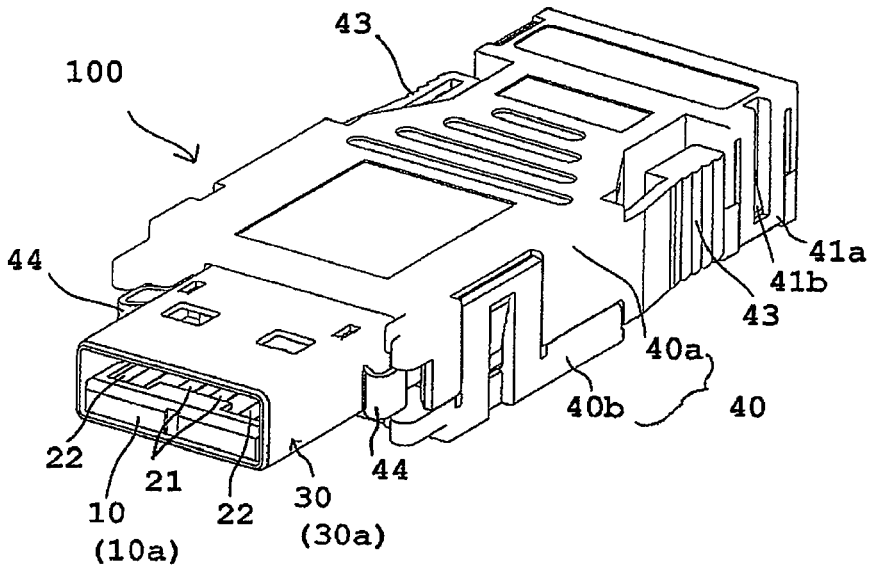
FIG. 1(A) is a front perspective view of an electrical connector according to an embodiment of the invention.
Figure 1B:
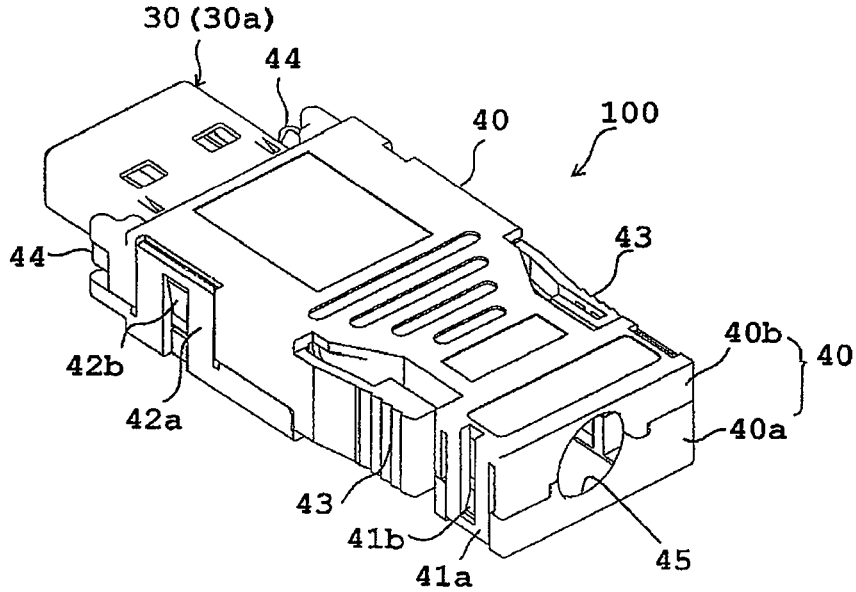
FIG. 1(B) is a rear perspective view of the electrical connector.
Figure 2:
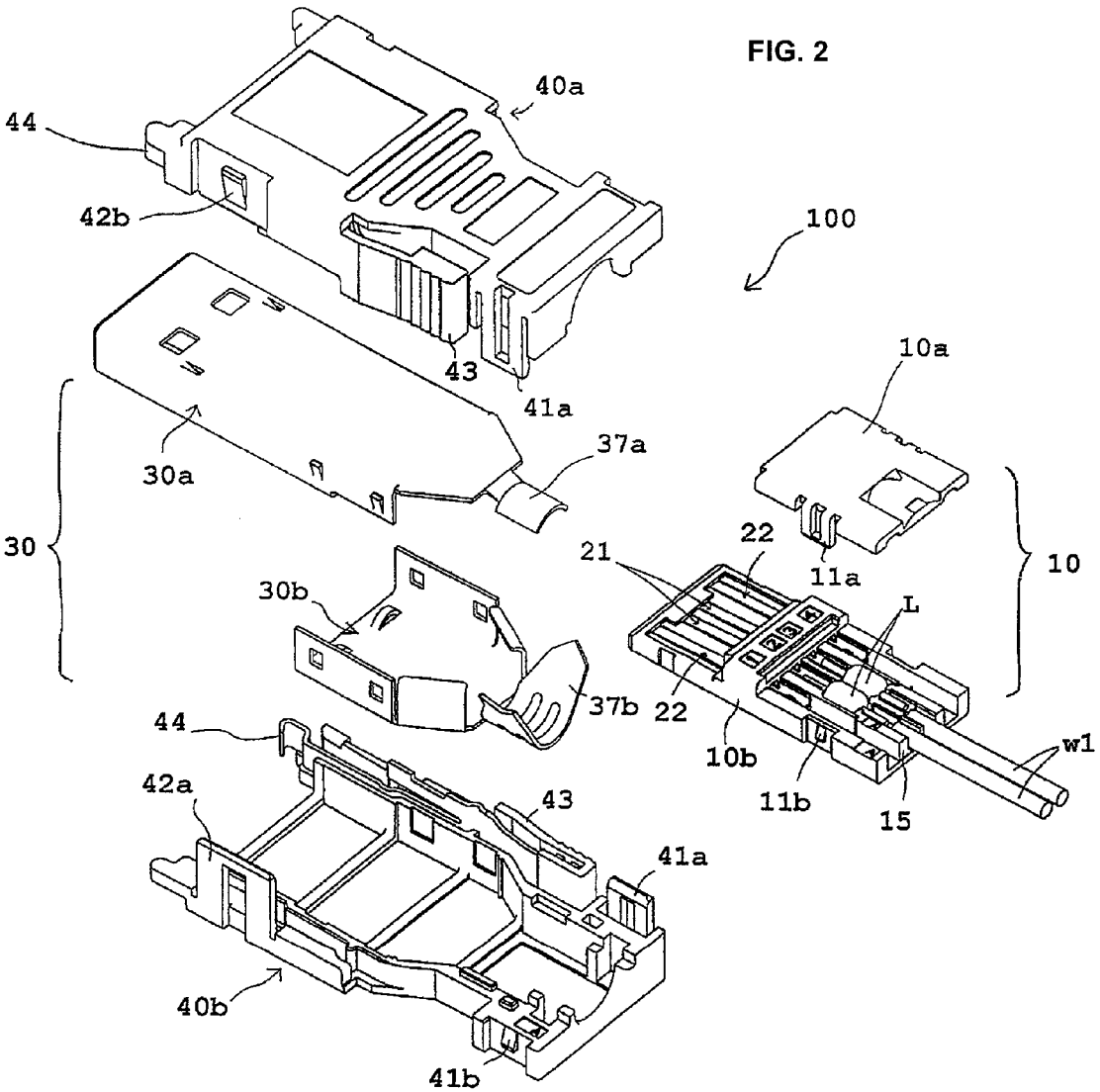
FIG. 2 is an exploded perspective view of the electrical connector.
Figure 3A:
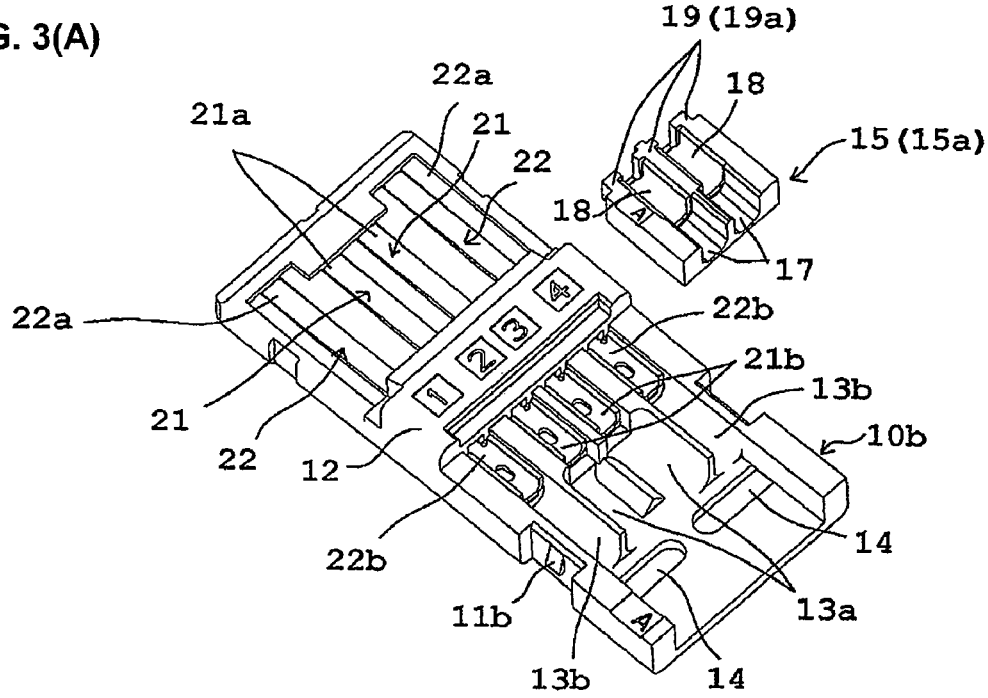
FIG. 3(A) is an exploded perspective view of a pre-assembled state of a main body portion and a spacer that comprise an inner housing of the electrical connector.
Figure 3B:
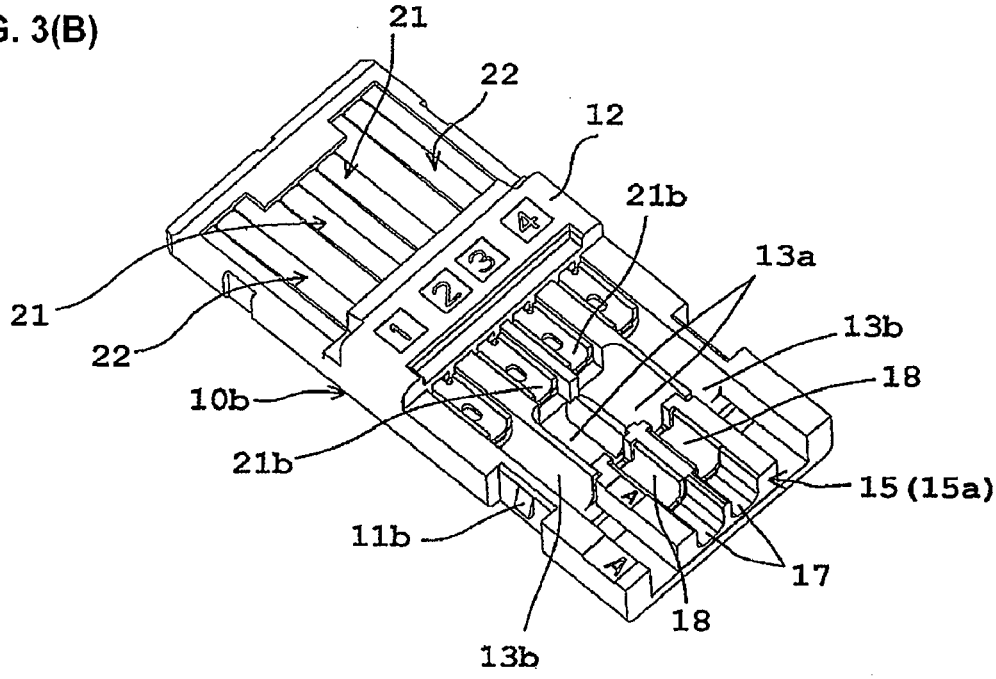
FIG. 3(B) is an exploded perspective view of an assembled state of a main body portion and a spacer that comprise an inner housing of the electrical connector.

As shown in FIG. 1(A) to 2, the electrical connector 100 comprises an inner housing 10 and an outer housing 40. The inner housing 10 has a main body portion 10*b* formed from a molded insulative resin that is configured as a base that extends from a front end to a rear end of the inner housing 10. Signal contacts 21 and power supply contacts 22 are retained inside the inner housing 10. As shown in FIGS. 3(A) to 3(B), the signal and power supply contacts 21, 22 are disposed in a substantially parallel arrangement on a front side of the main body portion 10*b*. In the illustrated embodiment, the signal contacts 21 are flanked by the power supply contacts 22. Tips of the signal contacts 21 are located at a more recessed position than tips of the power supply contacts 22 in order to conform to a USB standard that supports a function for hot-swapping electrical connectors.

As shown in FIGS. 3(A) to 3(B), the signal and power supply contacts 21, 22 are substantially flat members formed from a thin sheet of, for example, a copper alloy that has been stamped and folded. An intermediate portion of the signal and power supply contacts 21, 22 has a latching projection (not shown) configured for press-fitting into a contact-retaining member 12 on the main body portion 10*b* to retain the signal and power supply contacts 21, 22 in the inner housing 10. As necessary, each of the signal and power supply contacts 21, 22 is treated with gold plating or the like. The tips of the signal and power supply contacts 21, 22 form contact areas 21*a*, 22*a* that establish contact with other contacts when mating with another receptacle (not shown). The contact areas 21*a*, 21*b* are disposed so as to be exposed on the front upper surface of the main body portion 10*b*.

Bases 21*b*, 22*b* of the signal and power supply contacts 21, 22, respectively, are each formed in a substantially U-shape and are positioned in a grooved area that opens toward the upper surface of the main body portion 10*b*. One lead of an axial lead component L (FIG. 8), in the form of an inductor, is housed inside the inner housing 10 is received in the base 21*b* of the signal contact 21 and is soldered thereto to electrically connect the axial lead component to the signal contact 21. At a rear of the bases 21*b* of each of the signal contacts 21, a substantially concave component housing region 13*a* is provided to accept a main body of the axial lead component housed in the main body portion 10*b* of the inner housing 10. At the rear of the bases 22*b* of each of the power supply contacts 22, a groove 13*b* is provided to lead in a power supply line (not shown) of a cable (not shown). A tip of the power supply line (not shown) is guided by the groove 13*b* and is soldered to the base 22*b* of the power supply contact 22.

Figure 4A:
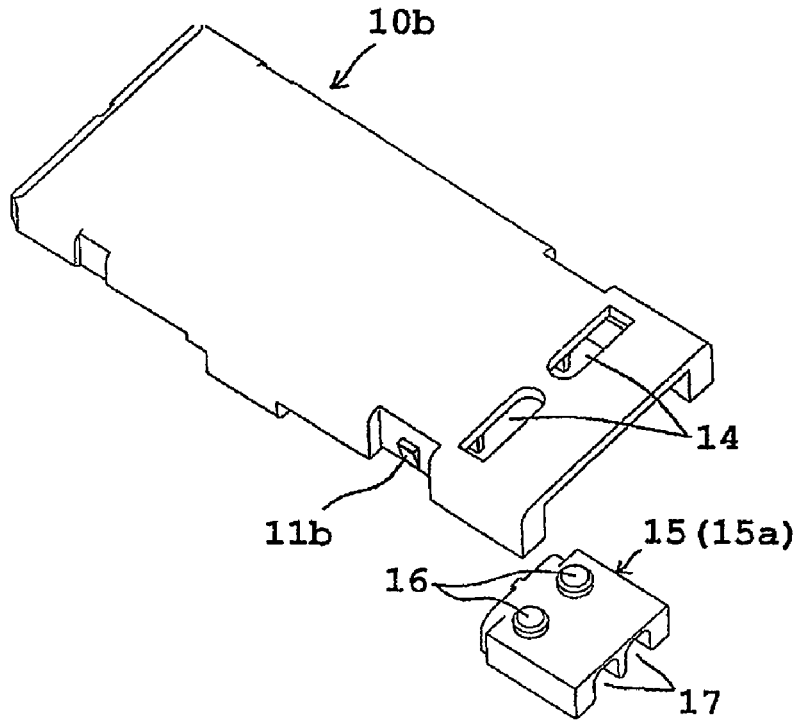
FIG. 4(A) is an exploded perspective view from below of the pre-assembled state of the main body portion and the spacer that comprise the inner housing of the electrical connector.
Figure 4B:
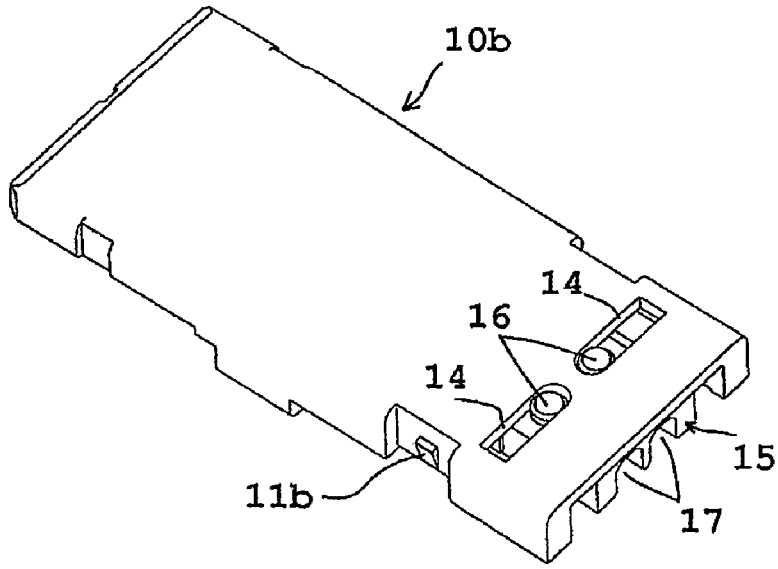
FIG. 4(B) is an exploded perspective view from below of the assembled state of the main body portion and the spacer that comprise the inner housing of the electrical connector.

As shown in FIGS. 3(A) to 3(B), behind the component housing region 13*a* and provided at a rear of the base 21*b* of each of the signal contacts 21 is a spacer 15 (15*a*), which is separate from the main body portion 10*b* of the inner housing 10. The spacer 15 (15*a*) is formed from a molded insulative resin. As shown in FIGS. 4(A) to 4(B), positioning projections 16 are formed on a bottom of the spacer 15 (15*a*). The positioning projections 16 are configured to engage slit-shaped positioning openings 14 provided on the bottom of the main body portion 10*b* near the rear thereof and install the spacer 15 (15*a*) at a predetermined position.

As shown in FIGS. 3(A) to 3(B), atop surface of the spacer 15 (15*a*) is provided with a pair of grooves 17. A substantially U-shaped terminal plate 18 is press-fitted into each of the grooves 17. The terminal plate 18 may be formed, for example, from a stamped and folded metal plate.

When the spacer 15 (15*a*) is installed in the main body portion 10*b* of the inner housing 10, each of the grooves 17 is positioned on an extension of each of the signal contacts 21, as shown in FIG. 3(B). In other words, the bases 21*b* of the signal contacts 21, the component housing regions 13*a*, and the U-shaped terminal plates 18 are arranged in a substantially straight line. The other lead of the axial lead component housed in the inner housing 10 is received in the groove 17 of the spacer 15 (15*a*) and then, via the terminal plate 18, is soldered to an end of a signal line w1 of a cable to establish an electrical connection, as shown in FIG. 2.

The spacer 15 (15*a*) is selected from among spacers prepared according to the size and shape of the axial lead component to be housed in the main body portion 10*b* of the inner housing 10 to have a shape suitable for forming the component housing region 13*a*. Thus, when installed in the main body portion 10*b*, the spacer 15 configures the main body portion 10*b* of the inner housing 10.

As shown in FIG. 2, the main body portion 10*b* is provided with a cover 10*a* that is installed from above. The cover 10*a*, as is the main body portion 10*b*, is formed from a molded insulative resin. The cover 10*a* is secured to the main body portion 10*b* by engaging a pair of locking tabs 11*a* provided on both side surfaces of the cover 10*a* with a pair of locking projections 11*b* provided on both side surfaces of the main body portion 10*b* of the inner housing 10. As a result, the axial lead component housed in the inner housing 10 is retained securely, and the electrical connections between leads on both ends of the axial lead component, the signal contacts 21, and the signal line w1 are stably maintained.

Figure 5A:
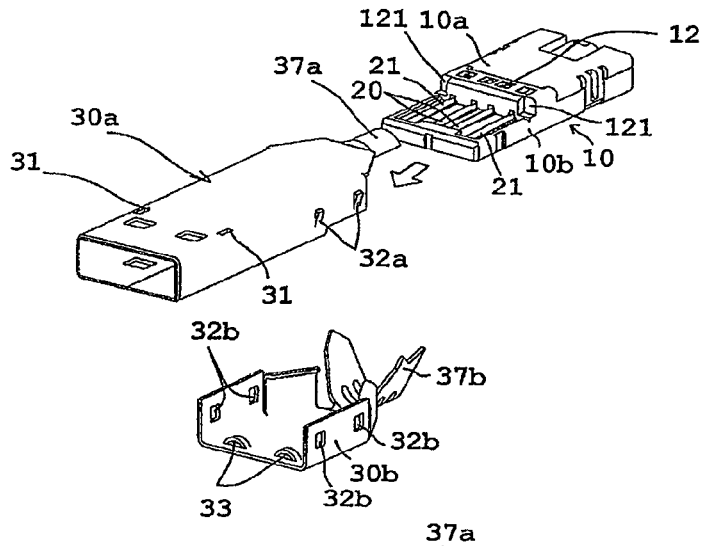
FIG. 5(A) is a perspective view of a pre-housed state of the inner housing in a metal shell.
Figure 5B:
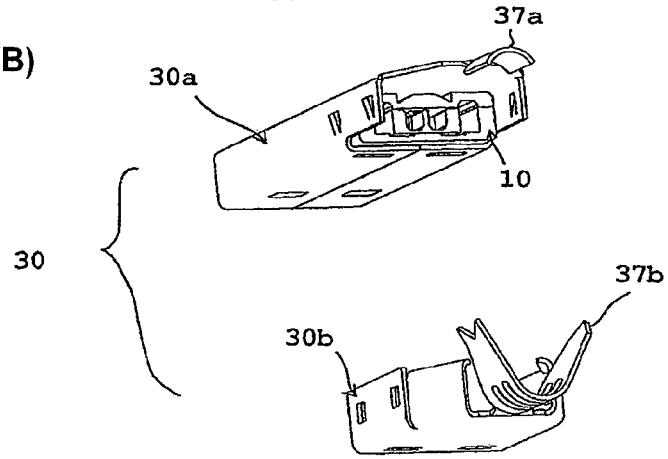
FIG. 5(B) is a perspective view of a housed state of the inner housing in the metal shell.
Figure 5C:
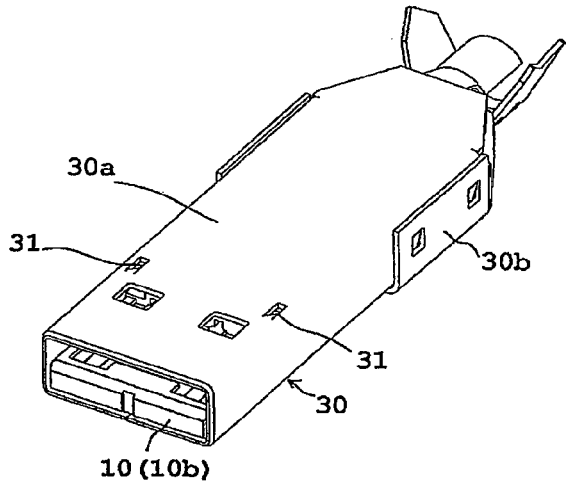
FIG. 5(C) is a perspective view of the housed state of the inner housing in the metal shell.

As shown in FIG. 2, a metal shell 30 that functions as a shield covers the inner housing 10 and helps to retain the signal and power supply contacts 21, 22. The metal shell 30 is separable into a main body portion 30*a* and a cover 30*b*. As shown in FIGS. 5(A) to 5(C), the inner housing 10 is inserted from the front thereof (where contact areas 21*a*, 21*b* of the signal and power supply contacts 21, 22 are disposed) into an opening at a rear of the main body portion 30*a* of the metal shell 30. The inner housing 10 is positioned by shoulder portions 121 on the contact-retaining member 12 against raised tabs 31 protruding inward from a top of the main body portion 30*a* of the metal shell 30. The cover 30*b* of the metal shell 30 is then installed on the rear of the bottom surface of the main body portion 30*a*. The cover 30*b* is installed on the main body portion 30*a* by engaging substantially rectangular openings 32*b* provided on each side surface thereof with the raised tabs 32*a* protruding outward from both side surfaces of the main body portion 30*a*. At this time, projections 33 on the cover 30*b* of the metal shell 30 mate with the positioning openings 14 in the main body portion 10*b* of the inner housing 10 to secure the positional relationship between the cover 30*b* and the main body portion 10*b*. Crimp areas 37*a*, 37*b* of the metal shell 30 are then crimped to a shield (not shown) of the cable (not shown) to establish an electrical connection there between so that the metal shell 30 can function as a shield.

As shown in FIG. 2, the metal shell 30 that houses the inner housing 10 is additionally housed in the outer housing 40. The outer housing 40 is formed from a molded insulative resin and is configured from two split bodies 40*a*, 40*b*. The split bodies 40*a*, 40*b* are substantially identical, and therefore only the split body half 40*b* is described herein.

Figure 6:
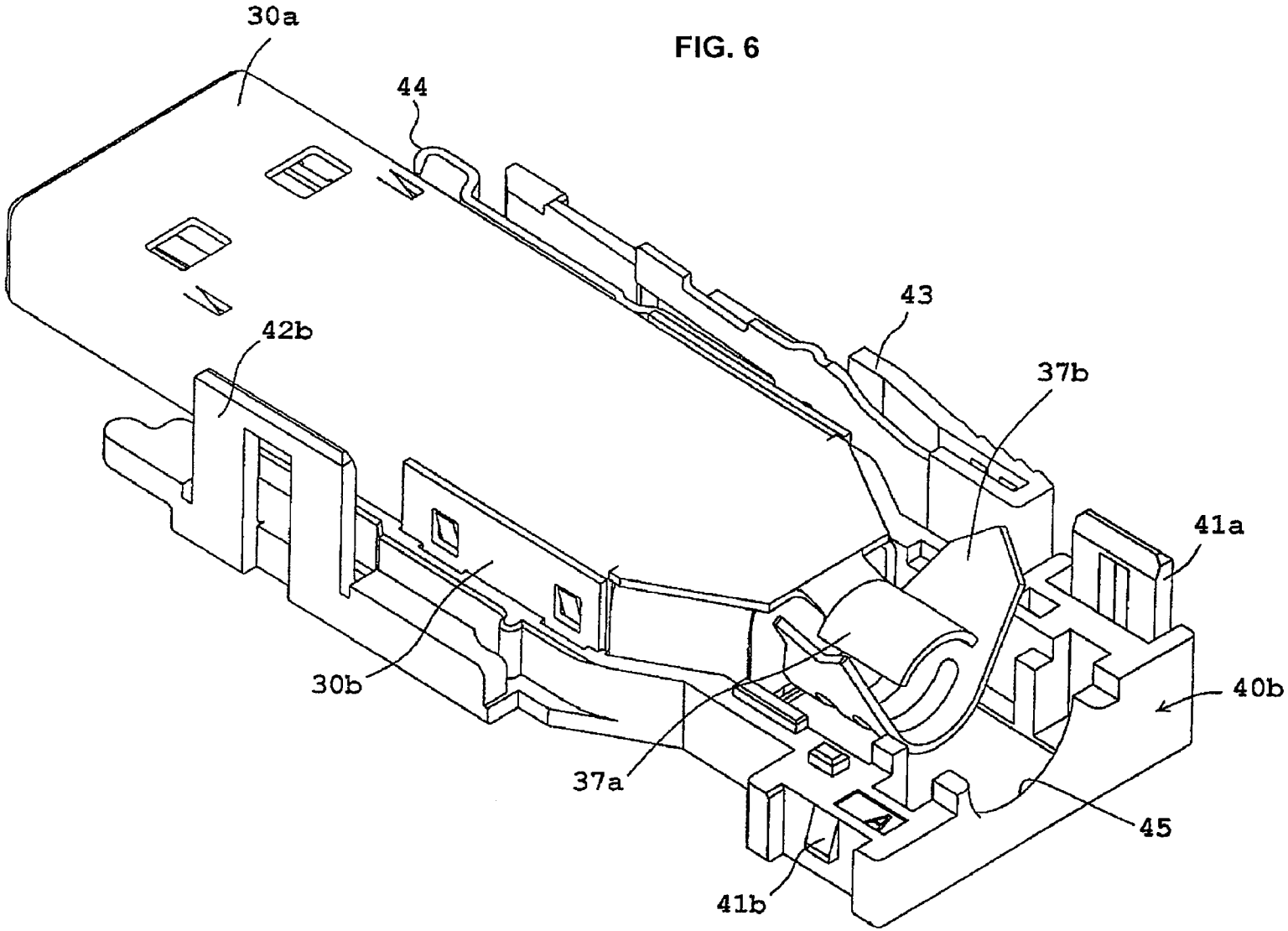
FIG. 6 is a perspective of the metal shell that houses the inner housing additionally housed in an outer housing.

As shown in FIG. 6, the split body 40*b* is provided with locking tabs 41*a*, 42*b* and locking projections 41*b*, 42*a* for attaching the split body 40*b* to the other split body 40*a*. On one side surface, the split body 40*b* is provided with a mating locking tab 44 and a mating lock release lever 43 so that in cases where the electrical connector 100 is used in industrial equipment, there is no risk of the electrical connector becoming unplugged from the receptacle due to vibrations or the like. As shown in FIG. 1(B), one end of the cable (not shown) can be guided through a cable opening 45 provided at a rear of the outer housing 40.

As shown in FIG. 1(A), a mating portion of the electrical connector 100 is configured as a USB-standard A-type plug that can be received in a USB-standard type-A receptacle (not shown). The mating portion of the electrical connector 100 is configured from a front portion of the inner housing 10 that retains the signal and power supply contacts 21, 22, and a front portion of the metal shell 30 that covers the front portion of the inner housing 10.

Figure 7:
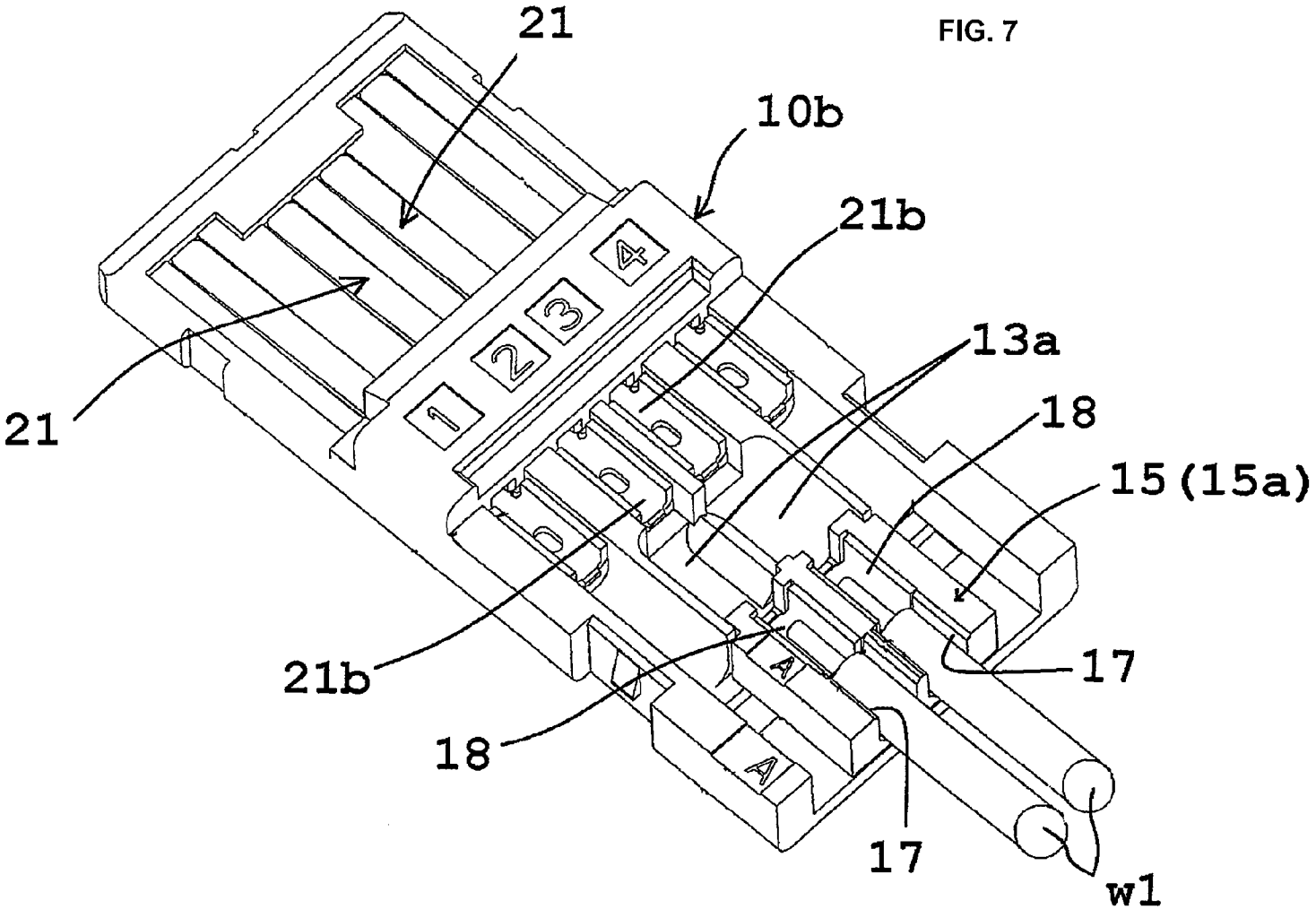
FIG. 7 is a perspective view of a cable inserted into the inner housing.

Attachment of the signal lines w1 to the spacer 15 (15*a*) will now be described in greater detail. As shown in FIG. 7, end portions of a pair of the signal lines w1 are introduced into the grooves 17 of the spacer 15 (15*a*) that has been installed at a predetermined position in the main body portion 10*b* of the inner housing 10. It is necessary for an insulative covering at a tip portion of each of the signal lines w1 to have been removed in advance over a length equal to the length of the terminal plate 18 fitted into the groove 17. To retain the signal line w1, the insulative covering of the signal line w1 that is introduced into the groove 17 is wedged into the groove 17, which has a width slightly narrower than an external diameter of the signal line w1. As a result, the end portions of the signal lines w1 introduced into the grooves 17 do not fall out of the spacer 15.

Figure 8:
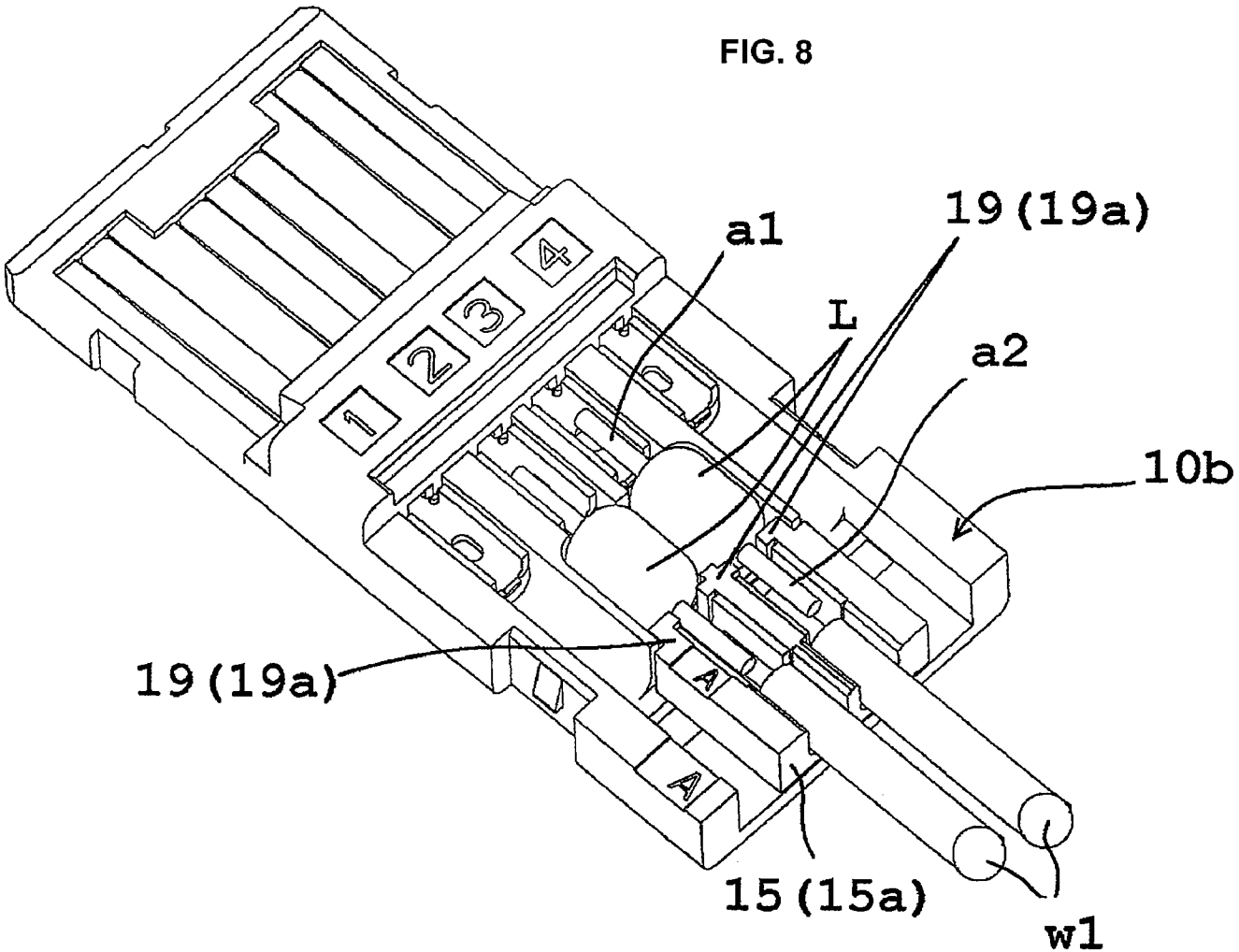
FIG. 8 is a perspective view of an axial lead component housed in the inner housing.
Figure 9:
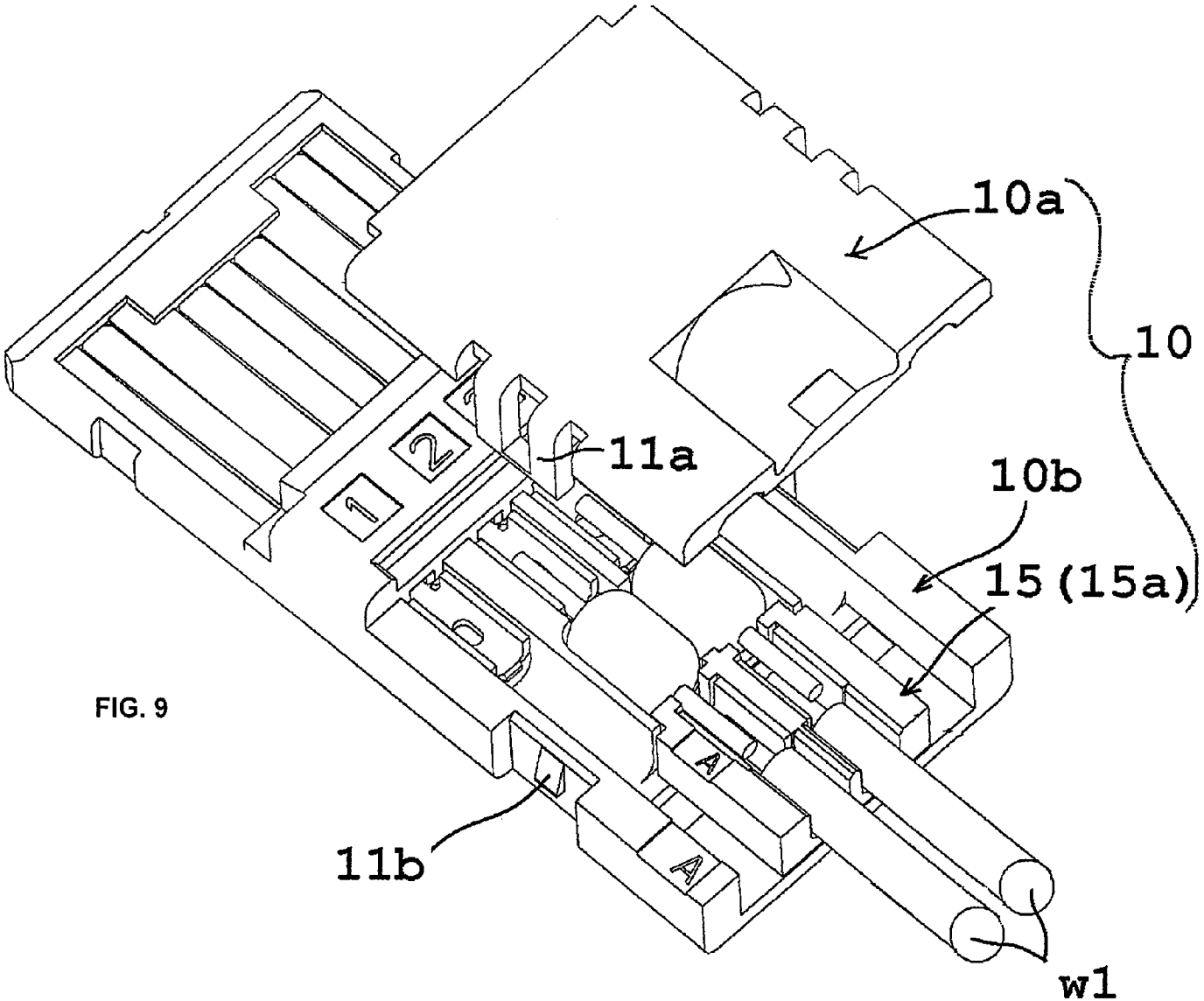
FIG. 9 is a perspective view of a cover installed on the inner housing that houses the axial lead component.
Figure 10:
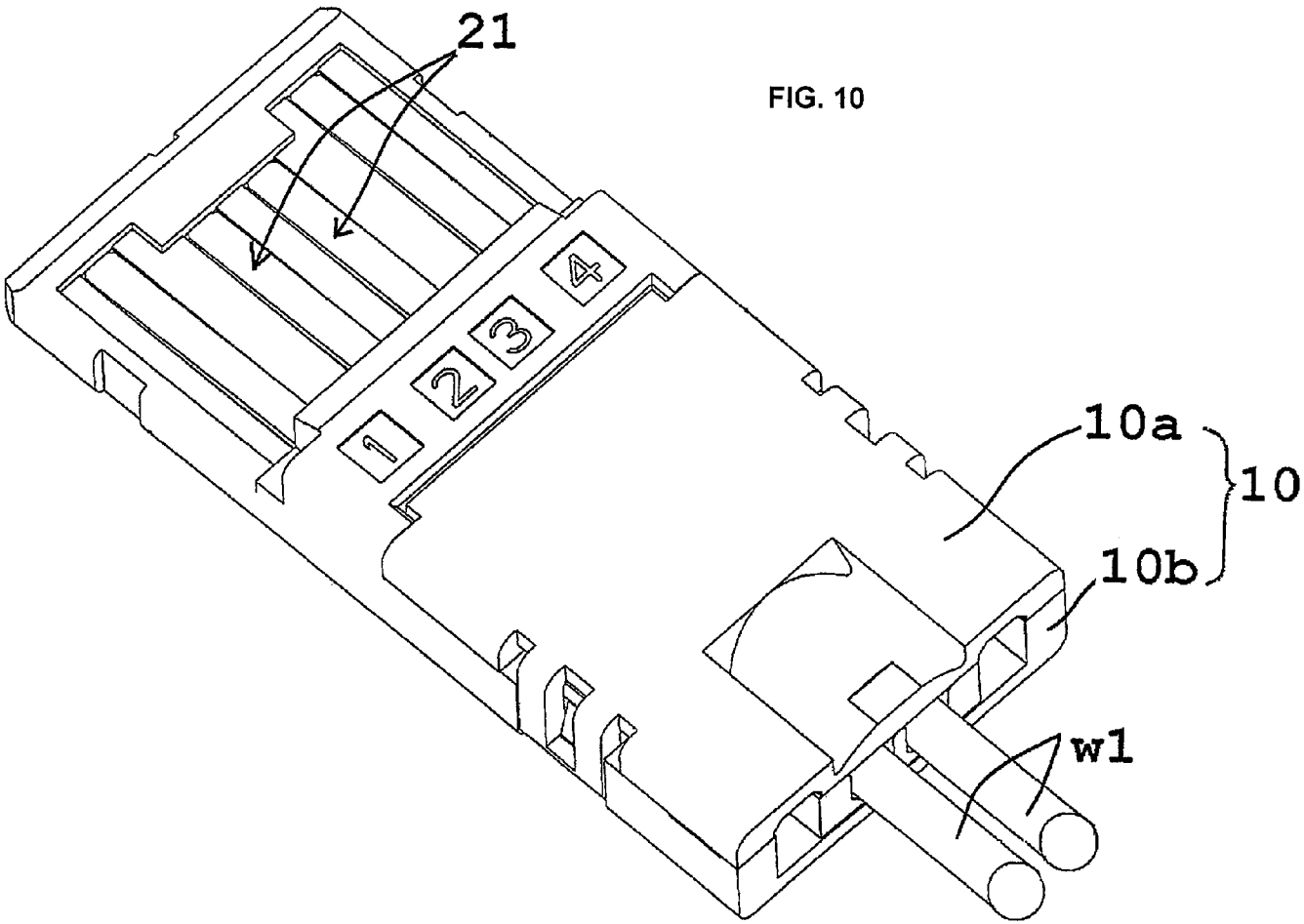
FIG. 10 is a perspective view of the inner housing wherein the axial lead component is housed and the cover has been installed.
Figure 11B:
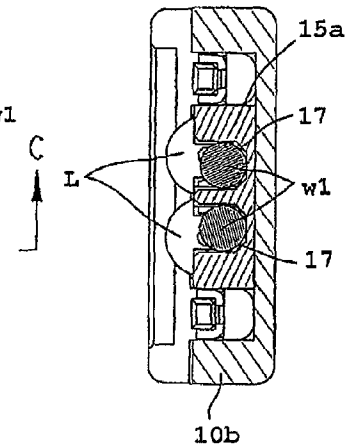
FIG. 11(B) is a cross-sectional view at the location B-B in FIG. 11(A).
Figure 11A:
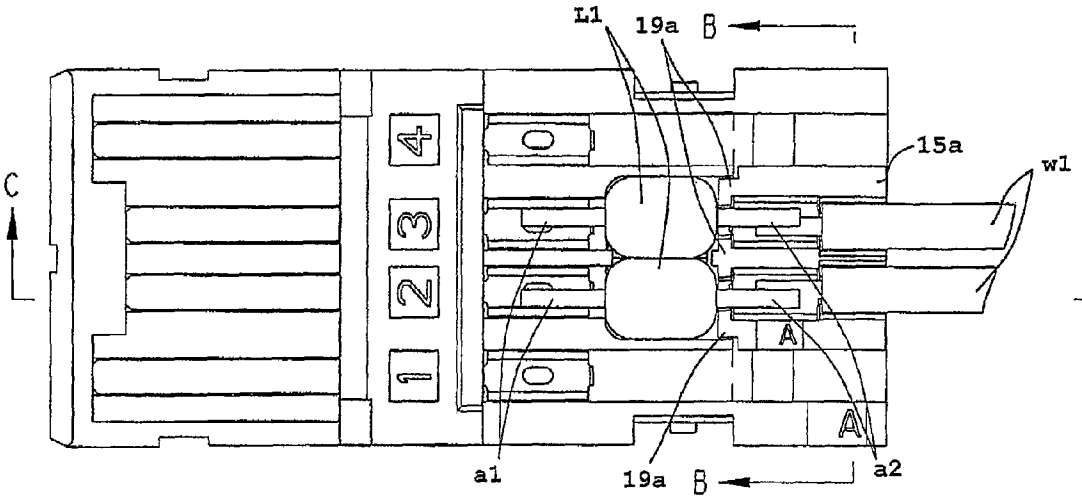
FIG. 11(A) is a plan view of the axial lead component retained in the inner housing by the main body portion and the spacer.
Figure 11C:
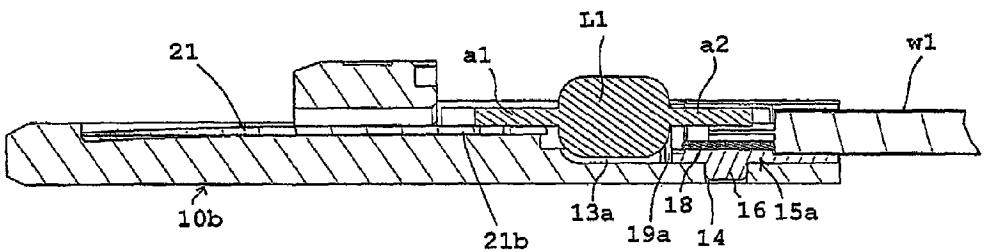
FIG. 11(C) is a cross-sectional view at the location C-C in FIG. 11(A).

As shown in FIG. 8, a main body portion of the axial lead component L is inserted into the component housing region 13*a*. One lead al of the axial lead component L is placed on the base 21*b* of the signal contact 21 and another lead a2 of the axial lead component L is placed on the terminal plate 18 in the groove 17 of the spacer 15 (15*a*). At this time, the signal contact 21, the axial lead component L, and the signal line w1 are arranged in a substantially straight line. In this state, one lead of the axial lead component L is soldered to the base 21*b* of the signal contact 21, and the other lead is soldered via the terminal plate 18 to the signal line w1. As a result, the axial lead component L is connected in series between the signal contact 21 and the signal line w1. As shown in FIG. 9, the cover 10*a* is then installed on the main body portion 10*b* of the inner housing 10 that houses the axial lead component L connected in series between the signal contact 21 and the signal line w1. As shown in FIG. 10, the inner housing 10 is now in a state ready for installation in the metal shell 30.

Here, the spacer 15 (15*a*) has been selected to have a shape capable of retaining the main body portion of the axial lead component L so that no gaps occur at a front or rear (along an axial direction) thereof. In other words, in accordance with the size of the main body portion of the axial lead component L, the length of a front side projection 19 (19*a*) is set so as to form a component housing region 13 with the front wall of the component housing region 13*a* provided at the rear of the base 21*b*of the signal contact 21 and with the front end of the spacer 15*a*. Moreover, the height of the spacer 15*a* is selected so that the leads of the axial lead component L are substantially horizontal.

Next, the selection of the spacer 15 according to the shape and size of the axial lead component L housed in the inner housing 10 is described with reference to FIGS. 11(A) to 13(B).

FIGS. 1(A) to 11(C) show the state in which an axial lead component L1 has a standard component shape and size and is assumed to be an inductor. The axial lead component L1 is housed in the component housing region 13*a* of the main body portion 10*b* that configures the inner housing 10. A radial direction (width direction of the inner housing 10) of a main body portion of the axial lead component L1 in the component housing region 13*a* of the main body portion 10*b* is determined by guiding lead ends a1, a2 of the axial lead component L1 to the base 21*b* of the signal contact 21 and to the groove 17 of the spacer 15*a*. An axial direction of each of the axial lead components L1 is determined by the front wall of the component housing region 13*a* provided at the rear of the base 21*b* of the signal contact 21 and by the projection 19 (19*a*) at the front of the spacer 15*a*, wherein the main body portion of the axial lead component L1 is housed there between.

Figure 12A:
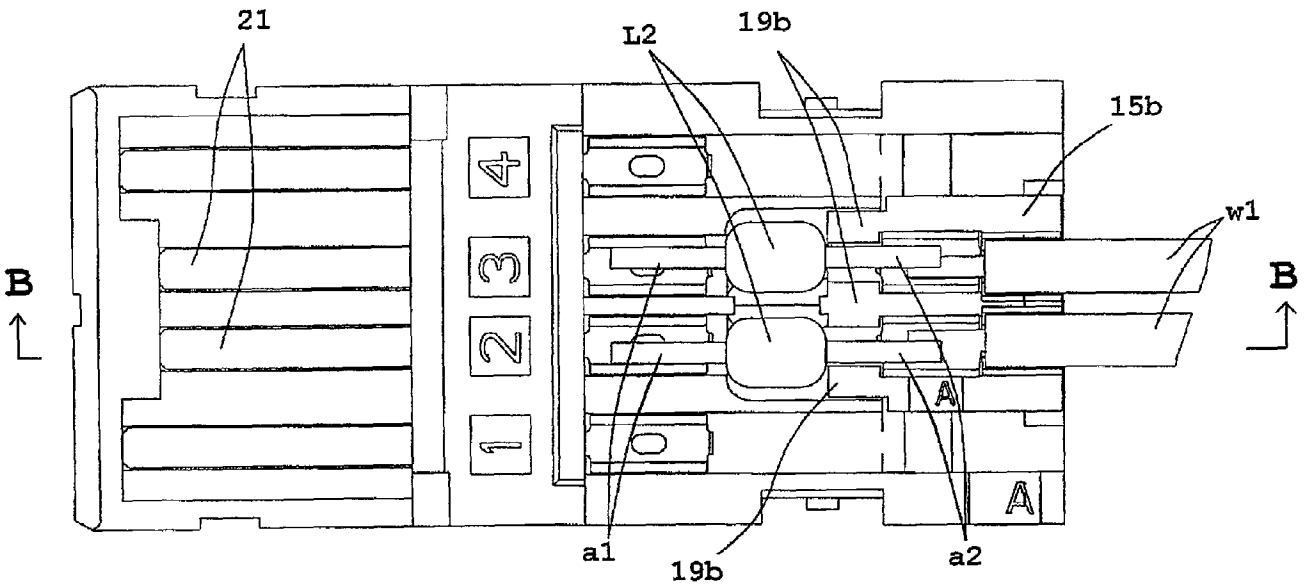
FIG. 12(A) is a plan view of a small-diameter axial lead component retained in the inner housing by the main body portion and the spacer.
Figure 12B:
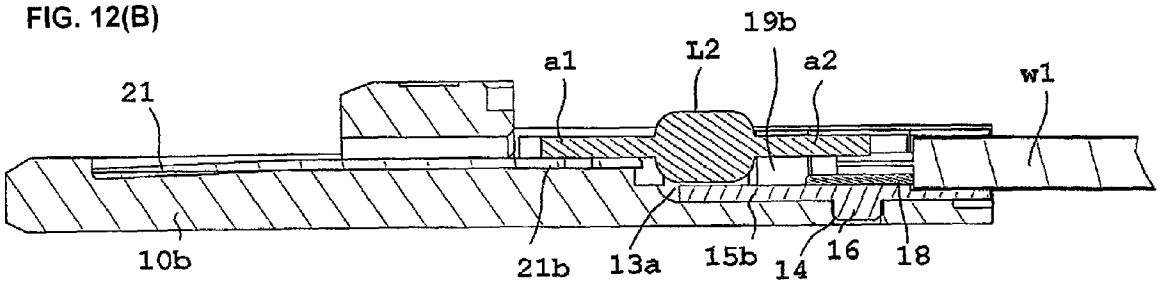
FIG. 12(B) is a cross-sectional view at the location B-B in FIG. 12(A).

FIGS. 12(A) to 12(B) show the state in which an axial lead component L2 is smaller than a standard component and is assumed to be an inductor. Specifically, the axial lead component L2 has a shorter axial length and smaller diameter than a standard component. The axial lead component L2 is housed in the component housing region 13*a* of the main body portion 10*b* of the inner housing 10. A radial direction of the main body portion of the axial lead component L2 in the component housing region 13*a* of the main body portion 10*b* of the inner housing 10 is determined by guiding the lead ends a1, a2 to the base 21*b* of the signal contact 21 and to the groove 17 of the spacer 15*a*. An axial direction of each of the axial lead components L2 is determined by the front wall of the component housing region 13*a* provided at the rear of the base 21*b* of the signal contact 21 and by the projection 19 (19*a*) at the front of the spacer 15*a*, wherein the main body portion of the axial lead component L1 is there between. The spacer 15*a* for the axial lead component L1 having a standard size and shape is thus unable to restrict the small axial lead component L2 in the axial direction. As a result, in cases where the axial lead component L2 housed in the main body portion 10*b* of the inner housing 10 is smaller than the assumed standard size, a spacer 15*b* is used instead of the spacer 15*a*.

The spacer 15*b* is provided with grooves 17 opened to the top surface. A substantially U-shaped terminal plate 18 is press-fitted into each of the grooves 17. The spacer 15*b* differs from the spacer 15*a* in that the projection 19 (19*b*) protrudes by a large amount such that the bottom portion extending to the bottom side of the main body portion of the small-diameter axial lead component L2 is disposed in the component housing region 13*a*. As a result, even in cases where the small-diameter axial lead component L2 is disposed in the component housing region 13*a* of the main body portion 10*b*. The main body portion of the axial lead component L2 can therefore be housed such that there is no wobbliness in the axial direction, and both sides of leads a1, a2 of the axial lead component L2 can be retained horizontally.

Figures 13A, 13B:
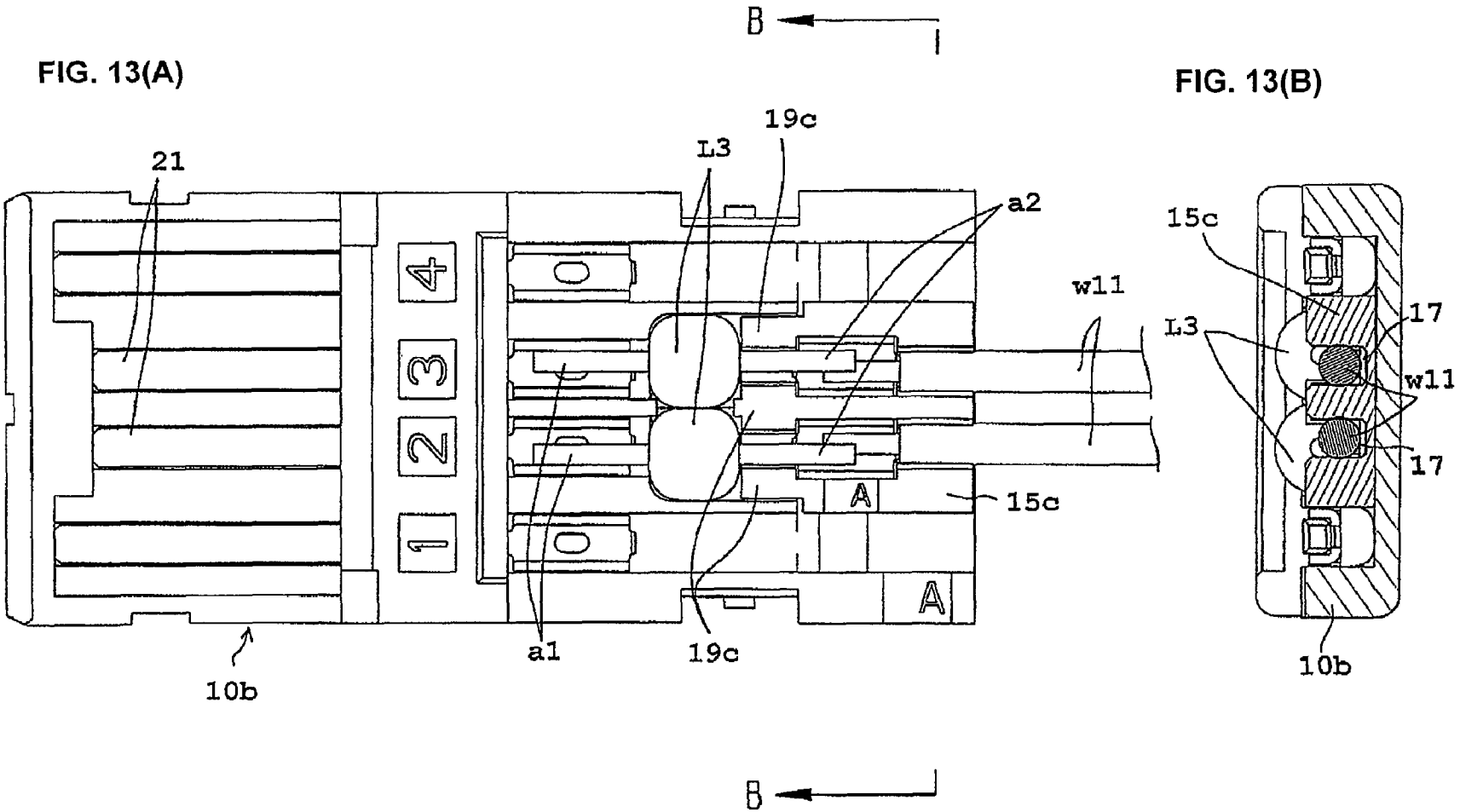
FIG. 13(A) is a plan view of a small-diameter axial lead component retained in the inner housing by the main body portion and the spacer.
FIG. 13(B) is a cross-sectional view at the location B-B in FIG. 13(A).
Figure 14A:
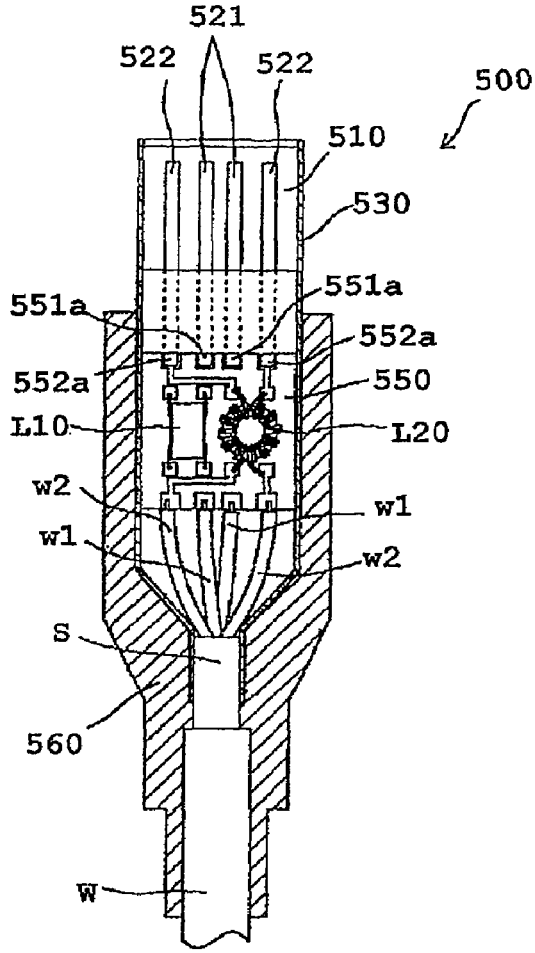
FIG. 14(A) PRIOR ART
FIG. 14(A) is a partial cross-sectional view of an internal structure of a conventional electrical connector that houses an inductor.
Figure 14B:
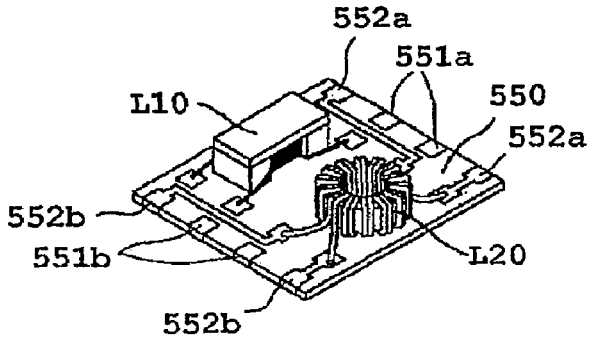
FIG. 14(B) PRIOR ART
FIG. 14(B) is a perspective view of the inductor installed on a small circuit board.

FIGS. 13(A) to 13(B) show the state in which signal lines w11 that are connected to an axial lead component L3, which is assumed to be an inductor, have a smaller external diameter than the aforementioned signal lines w1. The axial lead component L3 is housed in the component housing region 13*a* of the main body portion 10*b*. The signal line w11 connected to the axial lead component L3 has an external diameter that is smaller (narrower) than that of the signal line w1, which is assumed to have a standard external diameter. In a case where the signal line w11 is connected, each of the grooves 17 of a spacer 15*c* must have a width that is slightly narrower than the external diameter of the signal line w11. As a result, the signal line w11 can be retained by the groove 17 of the spacer 15*c*, and the task of soldering leads a1, a2 of the axial lead component L3 is simplified dramatically.

It is desired that the widths of the grooves 17 of the spacer 15 (15*a*, 15*b*, 15*c*) be approximately 90% of the diameter of the introduced signal lines w1. Moreover, it is desired that the length of the insulative covering retained by the grooves 17 of the spacer 15 to be at least 1.5 times the diameter of the cable. A retained length of at least 2 mm is desired.

As described above, the present invention makes it possible to configure the electrical connector 100 that houses an axial lead component L with almost no increase in the size of the electrical connector 100 compared to a conventional electrical connector. Furthermore, the spacer 15 is separate from the inner housing 10 that retains the signal contacts 21, and therefore it is possible to change the spacer 15 to accommodate the substantially concave region that houses the axial lead component L. As a result, even in cases of non-uniform shapes and sizes of the axial lead components L that have been selected as required, the advance preparation of only a single type of main body portion 10*b* is sufficient to enable the electrical connector 100 to house those axial lead components L.

In the electrical connector 100 whose shape is determined according to a prescribed standard, the present invention, provided with such characteristics as described above, makes it possible to configure an electrical connector 100 that houses an axial lead component or axial lead component L without significantly changing the overall shape of the electrical connector 100. Selecting the shape of the spacer 15, which is prepared as a component separate from the inner housing 10, according to the shape of the axial lead component L, makes it possible to retain the axial lead component stably within the inner housing 10. As a result, the task of mounting the axial lead component L can be accomplished with ease, and there is no need to prepare a different inner housing 10 for each shape of the axial lead component L. Moreover, because the electrical connector 100 conforms to the USB standard or other standard, the electrical connector 100 is suitable for use as a plug-type electrical connector that internally houses an axial lead component for suppressing high-frequency noise. This type of electrical conductor is especially suitable for configuring an interface connector for connections among information devices.

The foregoing illustrates some of the possibilities for practicing the invention. Many other embodiments are possible within the scope and spirit of the invention. For example, the axial lead component may be an inductor, resistor, capacitor, diode, or the like and is not limited by the embodiments illustrated herein. The invention herein may also be applied to an electrical connector not attached to an end of a cable or to a receptacle-type electrical connector. It is, therefore, intended that the foregoing description be regarded as illustrative rather than limiting, and that the scope of the invention is given by the appended claims together with their full range of equivalents.

What is claimed is:

1. An electrical connector for accommodating an axial lead component, the electrical connector comprising:

at least one signal contact having a contact area, the signal contact having a base formed opposite from the contact area that is configured to be electrically connected to a lead end of the axial lead component, the base being substantially u-shaped;

an insulative inner housing having a main body portion that receives the signal contact, the main body portion having a substantially concave component housing region proximate the base of the signal contact configured for receipt of a main body of the axial lead component; and a spacer formed separate from the inner housing that is attached to the main body portion proximate the component housing region, the spacer having a groove configured for receipt of another lead end of the axial lead component.

2. The electrical connector of claim 1, wherein the signal contact has an intermediate section press-fitted to the main body portion, the intermediate section being between the base and the contact area.

3. The electrical connector of claim 1, wherein the spacer has at least one positioning projection extending there from that engages an opening in the main body portion to fix the spacer thereto.

4. The electrical connector of claim 1, wherein the electrical connector is a Universal Standard Bus A-type plug.

5. The electrical connector of claim 1, wherein the spacer has a projection that extends into the component housing region.

6. The electrical connector of claim 1, wherein the spacer is insulative.

7. The electrical connector of claim 6, further comprising a metal terminal plate disposed within the groove of the spacer, the other lead end being electrically connected thereto.

8. The electrical connector of claim 1, wherein the inner housing further comprises a cover fixed to the main body portion.

9. The electrical connector of claim 8, further comprising a metal shell attached to an outside surface of the inner housing.

10. The electrical connector of claim 9, further comprising an insulative outer housing attached to an outside surface of the metal shell.

11. An electrical connector, comprising:

an axial lead component;

signal contacts each having a contact area and a base formed opposite from the contact area, the base being electrically connected to a lead end of the axial lead component;

an insulative inner housing having a main body portion that receives the signal contacts, the main body portion having a substantially concave component housing region proximate the base of the signal contact that receives a main body of the axial lead component; and an insulative spacer formed separate from the inner housing that is attached to the main body portion proximate the component housing region, the spacer having a groove with a metal terminal plate disposed therein that is electrically connected to another lead end of the axial lead component.

12. The electrical connector of claim 11, wherein the signal contact has an intermediate section press-fitted to the main body portion, the intermediate section being between the base and the contact area.

13. The electrical connector of claim 11, wherein the base is substantially u-shaped.

14. The electrical connector of claim 11, wherein the spacer has at least one positioning projection extending there from that engages an opening in the main body portion to fix the spacer thereto.

15. The electrical connector of claim 11, wherein the electrical connector is a Universal Standard Bus A-type plug.

16. The electrical connector of claim 11, wherein the spacer has a projection that extends into the component housing region to abut a rear of the main body of the axial lead component.

17. The electrical connector of claim 11, wherein the inner housing further comprises a cover fixed to the main body portion.

18. The electrical connector of claim 17, further comprising a metal shell attached to an outside surface of the inner housing.

19. The electrical connector of claim 18, further comprising an insulative outer housing attached to an outside surface of the metal shell.

* * * * *